United States Patent [19]

Theurer

[11] Patent Number: 4,596,193

[45] **Date of Patent: * Jun. 24, 1986**

[54] MOBILE TRACK LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[ * ] Notice: The portion of the term of this patent subsequent to Aug. 13, 2002 has been disclaimed.

[21] Appl. No.: 498,261

[22] Filed: May 26, 1983

[30] Foreign Application Priority Data

Sep. 9, 1982 [AT] Austria ..... 3386/82

[51] Int. Cl.[4] ..... E01B 27/17

[52] U.S. Cl. ..... 104/7 B; 104/12

[58] Field of Search ..... 104/2, 7 R, 7 B, 12

[56] References Cited

U.S. PATENT DOCUMENTS

| | | | |
|---|---|---|---|
| 3,469,534 | 9/1969 | Plasser et al. | 104/7 B |
| 3,494,297 | 2/1970 | Plasser et al. | 104/7 B |
| 3,595,170 | 7/1971 | Plasser et al. | 104/12 |
| 3,687,081 | 8/1972 | Plasser et al. | 104/12 |
| 3,690,262 | 9/1972 | Plasser et al. | 104/7 R |
| 3,744,428 | 7/1973 | Plasser et al. | 104/12 |
| 3,779,170 | 12/1973 | Plasser et al. | 104/12 |
| 4,356,771 | 11/1982 | Theurer | 104/7 B |

FOREIGN PATENT DOCUMENTS

| | | | |
|---|---|---|---|
| 1267322 | 3/1972 | United Kingdom . | |
| 2077821 | 12/1981 | United Kingdom | 104/7 B |
| 2094378 | 9/1982 | United Kingdom . | |

*Primary Examiner*—Randolph A. Reese
*Attorney, Agent, or Firm*—Kurt Kelman

[57] ABSTRACT

A mobile track tamping machine comprising two pivotally connected frames supported on two undercarriages spaced apart in the direction of the track for mobility on the track in an operating direction, the track consisting of two rails fastened to successive ties resting on ballast, a first one of the frames being a main frame of the machine and a second frame being a carrier frame for a ballast tamping unit arranged thereon between the two undercarriages. One undercarriage constitutes a single support and guide element for the second frame on the track, the second frame being pivotally connected to the first frame in the track direction whereby the other undercarriage constitutes a freely movable steering axle of the second frame.

3 Claims, 2 Drawing Figures

MOBILE TRACK LEVELING, LINING AND TAMPING MACHINE

Figure 1:
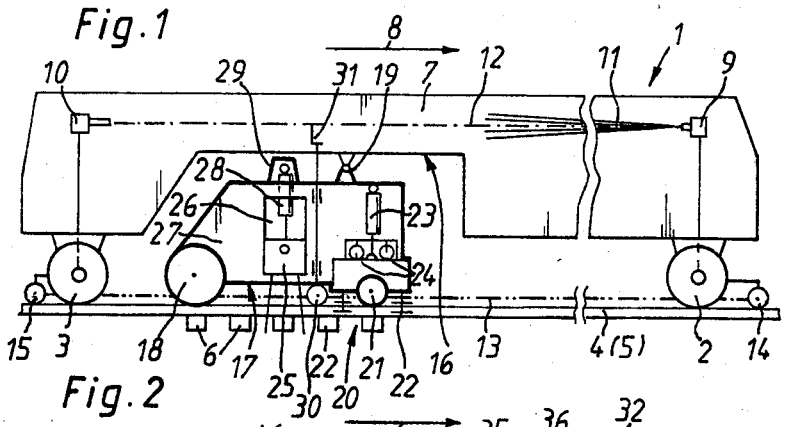

The present invention relates to a mobile track leveling, lining and tamping machine comprising two pivotally connected frames supported on two undercarriages spaced apart in the direction of the track for mobility on the track in an operating direction. The track consists of two rails fastened to successive ties resting on ballast. A first frame is the main frame of the machine and a second frame is a carrier frame for a ballast tamping unit arranged thereon between the two undercarriages.

U.S. Pat. No. 3,494,297, dated Feb. 10, 1970, discloses mobile track tamping machines capable of simultaneously tamping a plurality of ties with a succession of ballast tamping units associated with each track rail. One of the embodiments of the disclosed machines has the above-described structure and the succession of tamping units is mounted on the second frame which has two sets of wheels spaced apart in the direction of the track for guiding the second frame therealong. Two jacks link the second frame to the first frame for vertically adjusting the second frame in relation to the first frame and the second frame is equipped with rail clamps in the region of the two sets of wheels for lifting the track when the second frame is raised. A track lining tool unit is mounted at the rear of the machine, in the operating direction. This arrangement enables the track to be leveled in two successive stages.

U.S. Pat. No. 3,779,170, dated Dec. 18, 1978, relates to a mobile track tamping, leveling and lining machine wherein the ballast tamping units associated with each rail are transversely adjustable on the main machine frame. An inductive sensor is associated with each tamping unit for sensing the transverse position thereof in relation to the associated rail and a resultant control signal from the sensor controls a transverse adjustment drive so that the ballast tamping units are always centered over their associated track rails and thus are accurately positioned not only in tangent track but also in curves.

In the mobile track tamper of U.S. Pat. No. 3,595,170, dated July 27, 1971, two twin tamping units are mounted on a carrier frame and are adjustably positionable in relation to each other in the direction of track elongation. The carrier frame of the tamping units is laterally pivotally or adjustably connected to the main machine frame to enable the tamping units to be repositioned laterally in alignment with a curvature in the track, the tamping units being arranged between two undercarriages supporting the machine on the track. Since the carrier frame must support the weight and operating forces of all four tamping units, the frame structure must be massive and the pivoting or adjustment drive for the carrier frame requires considerable power.

U.S. Pat. No. 3,690,262, dated Sept. 12, 1972, discloses a mobile track tamping, leveling and lining machine with three undercarriages spaced apart in the direction of the track. A ballast tamping unit as well as a track leveling and lining tool unit are arranged between the center and rear undercarriages, in the operating direction, while the front undercarriage is adjustable in the track direction or the direction of elongation of the machine and may be vertically adjusted. In this manner, the machine frame may be selectively supported on the center or front undercarriage and the distance thereof from the track leveling and lining tool unit may be so adjusted in relation to the required lifting stroke for leveling the track that the track rails are only elastically deformed during the leveling operation and are not subjected to undue stresses which may cause permanent deformations in the rails. When the machine frame is supported on the front undercarriage, relatively large lifting strokes are made possible. On the other hand, the adjustability of the front undercarriage position makes it possible to maintain the proper wheel base when the machine is moved between working sites.

U.S. Pat. No. 3,469,534, dated Sept. 30, 1969, discloses a mobile track tamping, leveling and lining machine. In certain embodiments of this machine, the machine frame has a cantilevered portion projecting beyond the front undercarriage and being pivoted to the frame, the cantilevered front portion of the frame carrying ballast tamping units and a track lifting tool unit. The machine frame is supported on the track on the front and a rear undercarriage, and a track lining tool unit is mounted thereon between the undercarriages.

It is the primary object of this invention to provide a mobile track tamping machine of the first-indicated type but which is simpler with respect to the ballast tamping unit arrangement and enables the tamping tools associated with each rail to conform more closely to the level and the lateral alignment of the track wherealong it advances.

The above and other objects are accomplished according to the present invention in an unexpectedly simple manner in a machine of the first-described type with one of the undercarriages, which support the two pivotally connected frames for mobility on the track, constituting a single support and guide element for the second frame on the track, the second frame being pivotally connected to the first frame whereby the other undercarriage constitutes a freely movable steering axle of the second frame.

This structure for the first time provides a mobile track tamper in which the ballast tamping units associated with each rail are independently and precisely guided so that they must fully follow the vertical and lateral path of the track whereby an exact centering of the tamping tools on the gage and field sides of each rail with respect to the center line of the track is assured when the tools are immersed in the ballast for tamping ballast under the ties. Since each tamping unit conventionally comprises four to sixteen tamping tools which must be properly aligned with respect to each track rail, this automatic centering of the ballast tamping units is of great importance as far as an efficient and trouble-free tamping operation is concerned. This advantage is obtained by the freely movable steering axle of the carrier frame for the ballast tamping unit, which is the sole support and guide for the carrier frame on the track and whose free movement enables the carrier frame to follow the track since the other end of the carrier frame is merely pivotally connected to the main machine frame without any adjustment drive or position control. The pivotal connection between the carrier and main frames serves as the fulcrum for the free movement of the steering axle about this center of the axle's pivoting movement and this arrangement has considerable advantages over a ballast tamping unit carrier frame which runs on the track independently on the main frame on rear and front undercarriages. Thus, the carrier frame necessarily follows the movement of the main frame to which it is pivotally connected at its rear end while the distance between the rear end and the steering axle at its front end, i.e. the pivoting radius of the steering axle about the fulcrum, which is decisive for the positioning of the carrier frame in track curves, may be freely selected, this distance being simply a function of the length of the carrier frame. At the same time, the support of the carrier frame loaded by the heavy weight of the tamping units on the track provides an advantage over conventional tampers wherein the weight is carried by the main machine frame because it substantially reduces the stresses to which the main frame is subjected through the connecting joint between the main and carrier frames, particularly if the distance between the pivotal connection of the carrier frame to the main frame and the steering axle supporting the carrier frame on the track is selected relatively large within the structural limits of the machine. Finally, the distribution of the total weight of the machine over the two main undercarriages and the other undercarriage, which is the steering axle and which may be a single-axle undercarriage or a swivel truck, reduces the load on the individual undercarriages, which is of particular importance when the machine is used on branch tracks normally capable only of receiving limited loads.

Figure 2:
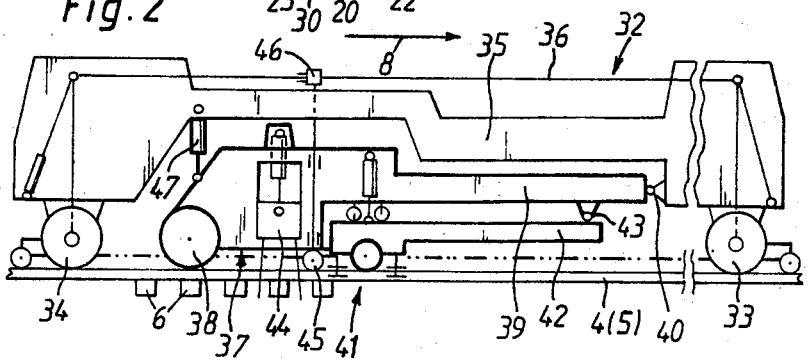

The above and other objects, advantages and features of the present invention will become more apparent from the following detailed description of certain now preferred embodiments, taken in conjunction with the accompanying drawing wherein FIG. 1 is a side elevational view of one embodiment of a mobile track tamping, leveling and lining machine according to this invention; and FIG. 2 is a like view of another embodiment.

Referring now to the drawing and first to FIG. 1, there is shown combined track tamping, leveling and lining machine 1 comprising two pivotally connected frames 7 and 17 supported on undercarriages 2, 3 and 18 for mobility on the track in an operating direction indicated by arrow 8. The track consists of two rails 4, 5 fastened to successive ties 6 resting on ballast (not shown). The two undercarriages 2, 3 are main undercarriages spaced apart in the direction of the track or machine elongation for supporting main frame 7 on the track and second or carrier frame 17 for ballast tamping unit 25 is arranged thereon between the two main undercarriages.

Illustrated machine 1 is equipped with an optical leveling reference system consisting of respective reference beam transmitter 9 supported in alignment with respective rail 4, 5 on front undercarriage 2 in a section of the track to be leveled and respective reference beam receiver 10 supported in alignment with a respective rail on rear undercarriage 3 in a previously leveled track section. Transmitter 9 emits conical reference beam 11 whose optical axis 12 (shown in a chain-dotted line) is aligned with receiver 10 and constitutes the reference line. The system may operate on the basis of infrared or laser beams, for example.

The machine also has a lining reference system consisting of front and rear track sensing elements 14 and 15 wherebetween reference wire 13 (also shown in a chain-dotted line) is tensioned centered between the rails.

Second or carrier frame 17 for ballast tamping unit 25 is mounted in upwardly recessed elongated portion 16 of first or main frame 7 between main undercarriages 2 and 3. Another undercarriage 18 constitutes a single support and guide element for carrier frame 17 on the track and the carrier frame is pivotally connected at joint 19 to main frame 7 whereby the other undercarriage constitutes a freely movable steering axle of carrier frame 17. In the illustrated embodiment, undercarriage 18 is constituted by a single-axle set of flanged wheels to guide the carrier frame rear end along the track. Machine 1 comprises track leveling and lining means 20 whereby the machine is a combined tamping, leveling and lining machine. The carrier frame is arranged between the two main undercarriages 2, 3 and is guided separately from the main frame along the track by freely movable steering axle 18 for movement with the main frame. Carrier frame 17 is supported on the track by steering axle 18 and on main frame 7 at point 19 spaced from the steering axle in the direction of the track. The ballast tamping unit comprises a tamping tool carrier and drive 28 vertically adjusts the tamping tool carrier on main frame 7. A plurality of pairs of vibratory and reciprocatory tamping tools are mounted on the carrier for immersion in successive cribs, with a respective tie 6 positioned between the tools of the pairs. The track leveling and lining means comprises track lifting and lining tool unit 20 mounted on carrier frame 17 and including drive means 23, 24 for the lifting and lining tools. Carrier frame 17, ballast tamping unit 25 and track lifting and lining tool unit 20 constitute a unitary operating structure adjacent one of the main undercarriages, i.e. rear undercarriage 3. Steering axle 18 supports a rear end of carrier frame 17, in the operating direction.

This particularly advantageous embodiment provides a unitary operating structure for all the units participating in the correction of the track position and fixing of the track in the corrected position so that all the operating tools, including the many tamping tools immersed in the ballast to the right and left of each rail as well as the track lifting and lining tools, are properly centered laterally with respect to the rails. The operating units in such a unitary structure may be freely selected according to specific requirements. For example, tamping units widely accepted in the industry either for use in tangent track or in switches may be built into such a unitary operating structure as well as suitable track lifting and lining tool units widely used in track surfacing work. This use of commercially available units reduces costs and work in building the machines. In addition, such a unitary operating structure has the added advantage of giving a machine operator ready visual access to the track surfacing work in progress.

Illustrated track leveling and lining tool unit 20 comprises flanged lining rollers 21 engaging rails 4, 5 and centered between pairs of lifting rollers 22, 22. A respective lifting drive 23 in alignment with each rail and transversely extending lining drives 24 link unit 20 to carrier frame 17.

The tamping tool carrier of ballast tamping unit 25 is arranged in opening 26 in side wall 27 of carrier frame 17 and vertical adjustment drive 28 links the tamping tool carrier to the carrier frame, an upper end of drive 28 being connected to upwardly projecting bracket 29 of the carrier frame.

The leveling and lining reference systems include, in a well known manner, sensing element 30 which is guided without clearance along rails 4, 5 between tamping unit 25 and lifting and lining unit 20 for measuring the vertical and lateral position of the track. A shadow board 31 is mounted on the track sensing element in alignment with each rail and will interrupt reference beam 12 when the respective rail has reached the desired level. This causes receiver 10 to emit a control signal which is transmitted to lifting drive 23 for holding track lifting and lining tool unit 20 in position so that the track is held at the desired level. Track sensing element 30 operates in a like manner, as is quite conventional, to control lining drives 24 in coopertation with tensioned reference wire 13. Since carrier frame 17 for the lifting and lining tool unit is supported and guided vertically and laterally independently of main machine frame 7, the lifting and lining tools automatically and precisely follow the path of the track.

In tamping, leveling and lining machine 32 of FIG. 2, main machine frame 35 is supported for mobility on the track in an operating direction indicated by arrow 8 on front undercarriage 33 and rear undercarriage 34. The leveling reference system, with which the machine is equipped, comprises a respective tensioned reference wire 36 associated with each rail 4, 5, the front end of each wire being supported on front undercarriage 33 in a track section to be corrected and each rear wire end being supported on rear undercarriage 34 in a previously corrected track section. Second or carrier frame 37 of machine 32 has the form of a carriage axle with a pole, i.e. the carrier frame has, in the operating direction, a rear portion adjacent rear undercarriage 34 of the main frame and pole portion 39 extending forwardly therefrom. Steering axle 38 comprises a set of flanged wheels on a single axle running on the track rails and supporting the rear frame portion thereon. Ballast tamping unit 44 is supported on the rear frame portion and pole portion 39 has a front end linked to first or main frame 35 of machine 32 by universal joint 40 pivotally connecting the front end of second or carrier frame 37 to first or main frame 35. Pole portion 39 of the carrier frame is constituted by an elongated boom-shaped carrier extending in the operating direction or direction of elongation of the machine.

Connecting the carrier frame by a universal joint to the main frame and supporting it thereon by such a joint at a point spaced from the steering axle of the carrier frame assures in a simple manner a free movement of the carrier frame with respect to the main frame in all directions. The described carrier frame is functionally and structurally very useful in the combined machine of the present invention. Using a single-axle set of wheels as the steering axle of the carrier frame imparts favorable running characteristics thereto and provides good steering and safety against derailment even in switch sections of the track so that the machine may be moved without problems and at high speeds from working site to working site. Using an elongated boom-shaped carrier as the front pole portion of the carrier frame leaves sufficient space at both sides thereof for mounting the lifting and lining tools and enables the universal connecting joint at the front end to be accommodated between the side beams of the main machine frame. Such a carrier frame also is relatively light and economical to construct. It has full freedom of lateral movement in relation to the main machine frame, which is particularly necessary for tamping in switches.

Ballast tamping unit 44 is arranged immediately adjacent, and frontward of, steering axle 38, in operating direction 8, and main frame 35 has an upwardly recessed elongated portion wherein carrier frame 37 is arranged. This produces a structurally simple arrangement wherein the carrier frame and ballast tamping unit are integrated into the main machine frame while affording sufficient freedom of movement of the carrier frame in the operating direction and transversely thereto.

As in the embodiment of FIG. 1, track leveling and lining tool unit 41 is mounted on second frame 37 and includes drive means for lifting and lining tools, ballast tamping unit 44 being arranged between the flanged wheels of steering axle 38 and track leveling and lining tool unit 41, a drive vertically adjusting the ballast tamping unit and first frame 35 defining an elongated opening for receiving the drive. Track leveling and lining tool unit 41, like carrier frame 37, comprises a rear portion, which is adjacent the rear portion of carrier frame 37 and pole portion 42 extending forwardly therefrom. Flanged lining rollers support the rear portion of unit 41 on the track rails, drive means for the leveling and lining tools connect the rear portion of unit 41 to carrier frame 37, and pole portion 42 has a front end linked by universal joint 43 to the carrier frame and extends in the operating direction. This type of structure for a track leveling and lining tool unit has been used in track tampers but it is particularly advantageous in the machine of this invention because it makes use of the space available under the carrier frame and no additional space is required for this unit on the machine.

Track sensing element 45 is guided without clearance along the rails between tamping unit 44 and leveling and lining unit 41 and associated rotary potentiometer 46 cooperates with each leveling reference wire 36 to generate a respective control signal for the leveling operation. Drive 47 links the rear portion of carrier frame 37 to main frame 35 and enables the carrier frame to be lifted off the track so that the steering axle wheels, the lifting and lining tool rollers and sensing element 45 are out of contact with the rails, for example when the machine moves between operating sites. The drive may also be used to impart a vertical downward load to the carrier frame during operations, for example during tamping of a heavily encrusted ballast sections requiring high immersion forces for the tamping tools.

What is claimed is:

1. A mobile track leveling, lining and tamping machine comprising a main frame supported on two undercarriages spaced apart in the direction of the track for mobility on the track in an operating direction, the track consisting of two rails fastened to successive ties resting on ballast, a carrier frame arranged between the two uncercarriages, a ballast tamping unit supported on the carrier frame, a single support and guide carriage supporting and guiding the carrier frame on the track, the support and guide carriage being spaced from one of the undercarriages immediately preceding the support and guide carriage in the operating direction, the ballast tamping unit immediately preceding the support and guide carriage in the operating direction, a pivotal connection supporting the carrier frame on the main frame for pivotally connecting the carrier frame to the main frame, the pivotal connection being spaced from the support and guide carriage in the direction of the track and preceding the support and guide carriage in the operating direction, and track leveling and lining means supported on the carrier frame preceding the ballast tamping unit in the operating direction.

2. The track leveling, lining and tamping maching of claim 1, wherein the ballast tamping unit comprises a tamping tool carrier, a drive for vertically adjusting the tamping tool carrier on the carrier frame, and a plurality of pairs of vibratory and reciprocatory tamping tools mounted on the tamping tool carrier for immersion in successive cribs, with a respective one of the ties positioned between the tools of the pairs, and the track leveling and lining means comprises a track lifting and lining tool unit mounted on the carrier frame and including drive means for the lifting and lining tools, the carrier frame, the ballast tamping unit and the track lifting and lining tool unit constituting a unitary operating structure immediately adjacent one of the undercarriages of the main frame following the unitary operating structure in the operating direction.

3. The track leveling, lining and tamping machine of claim 1, wherein the pivotal connection is a universal joint connecting a front end of the carrier frame, in the operating direction, to the main frame.

* * * * *